US005690265A

United States Patent [19]

Jakob

[11] Patent Number: 5,690,265

[45] Date of Patent: Nov. 25, 1997

[54] STAPLING DEVICE

[76] Inventor: Hans-Helmut Jakob, Gottlieb-Daimler-Str. 5, 64319 Pfungstadt, Germany

[21] Appl. No.: 639,258

[22] Filed: Apr. 24, 1996

[30] Foreign Application Priority Data

May 3, 1995 [DE] Germany ..... 195 16 164.5

[51] Int. Cl.[6] ..... B42B 4/02

[52] U.S. Cl. ..... 227/81; 227/85; 227/92; 227/155

[58] Field of Search ..... 227/81, 82, 83, 227/84, 85, 86, 93, 95, 97, 155

[56] References Cited

U.S. PATENT DOCUMENTS

| | | | |
|---|---|---|---|
| 2,709,808 | 6/1955 | Murrell et al. | 227/81 |
| 2,722,000 | 11/1955 | Turrall | 227/81 |
| 2,818,568 | 1/1958 | Turrall et al. | 227/81 |
| 2,964,749 | 12/1960 | Kwasniewski et al. | 227/155 |
| 2,987,729 | 6/1961 | Taynton | 227/155 X |
| 3,653,570 | 4/1972 | Alsop | 227/81 |
| 3,762,622 | 10/1973 | Noren | 227/81 |
| 4,204,627 | 5/1980 | Kutzner et al. | 227/81 |
| 4,328,919 | 5/1982 | Lawrence et al. | 227/155 |

*Primary Examiner*—Joseph J. Hail, III
*Assistant Examiner*—Jay A. Stelacone
*Attorney, Agent, or Firm*—Friedrich Kueffner

[57] ABSTRACT

A device for connecting products composed of stacked and continuously conveyed webs or sheets of paper or the like, wherein the webs or sheets are connected by a wire-like stapling material which can be cut and deformed into individual clamps. The stapling device includes a supply roll with conveying unit for the stapling material, a cutting device for cutting the stapling material to a length required for forming the clamps, a clamp forming unit, a plunger for pushing the formed clamps into the product and a clamp closing unit. The supply roll with the conveying unit, the cutting device and the plunger of the stapling device are mounted on a rotatable drum-shaped body which approximately contacts the product on one side thereof transversely of the conveying direction. The clamp forming unit is composed of a pocket provided in the drum-shaped body and a radially displaceable clamp forming body which rotates synchronously with the drum-shaped body and is mounted on the same side of the product as the drum-shaped body, wherein the axis of rotation of the clamp forming body extends parallel to the axis of the drum-shaped body. The clamp closing unit is mounted on a rotatable body which is located on the side of the product opposite of the drum-shaped body and can also be driven synchronously with the drum-shaped body.

11 Claims, 3 Drawing Sheets

STAPLING DEVICE

BACKGROUND OF THE INVENTION

1. Field of the Invention

The present invention relates to a device for connecting products composed of stacked and continuously conveyed webs or sheets of paper or the like, wherein the webs or sheets are connected by means of a wire-like stapling material which can be cut and deformed into individual clamps. The stapling device includes a supply roll with conveying unit for the stapling material, a cutting device for cutting the stapling material to a length required for forming the clamps, a clamp forming unit, a plunger for pushing the formed clamps into the product and a clamp closing unit.

2. Description of the Related Art

Magazines, brochures, catalogues or the like, which consist of several sheets or double sheets, are initially formed of individual stacked and continuously conveyed webs, or sheets of paper or the like already cut from webs, wherein the webs or sheets are then connected to one another by stapling by means of two or more clamps, predominantly of metal, which are in alignment with each other. Subsequently, the webs or sheets are folded in the area of the clamps and are cut.

For placing the clamps in the webs or sheets, devices are known in the art which include carriages mounted above and below the webs or sheets and reciprocating in conveying direction. For placing the clamps, the carriages are accelerated for a short period of time to the conveying speed of the webs or sheets. These carriages are equipped with one or more stapling heads, wherein each stapling head is composed of a lower part and a part arranged in the upper carriage. One part of the stapling head serves to introduce the clamps into the products to be formed of the webs or sheets, while the other part of the stapling heads closes the clamps having a U-shaped configuration. The clamps to be processed may either be prefabricated or may be formed in the part of the stapling head which serves to introduce the formed clamps into the products to be stapled.

Because of the fact that the carriages carrying the stapling head parts must initially be accelerated to the conveying speed of the products formed by the stacked webs or sheets and must then be decelerated and moved in the opposite direction into the initial position, the conveying speed of the products may not exceed a certain value, so that the output of finished products is limited as a result.

SUMMARY OF THE INVENTION

Therefore, it is the primary object of the present invention to provide a device for connecting products formed of stacked and continuously conveyed webs or sheets of paper or the like by means of a wire-like stapling material which can be deformed into individual clamps, wherein the device makes possible a higher conveying speed of the products formed of the stacked webs or sheets and wherein, consequently, the output of stapled products is increased.

In accordance with the present invention, the supply roll with the conveying unit, the cutting device and the plunger of the stapling device are mounted on a rotatable drum-shaped body which approximately contacts the product on one side thereof transversely of the conveying direction. The clamp forming unit is composed of a pocket provided in the drum-shaped body and a radially displaceable clamp forming body which rotates synchronously with the drum-shaped body and is mounted on the same side of the product as the drum-shaped body, wherein the axis of rotation of the clamp forming body extends parallel to the axis of the drum-shaped body. The clamp closing unit is mounted on a rotatable body which is located on the side of the product opposite of the drum-shaped body and can also be driven synchronously with the drum-shaped body.

In the stapling device according to the present invention, the carriages required in the past can be omitted. The rotating components of the device which support the supply roll, the clamp forming unit, the plunger and the clamp closing unit, can rotate continuously with a circumferential speed which corresponds exactly to the conveying speed of the products formed of the stacked webs or sheets. An acceleration or deceleration and a reversal of movement are no longer required. This makes it possible to achieve higher conveying speeds of the products to be stapled and, thus, an increased output of finished products. The increased output is also due to the lower masses of the device.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
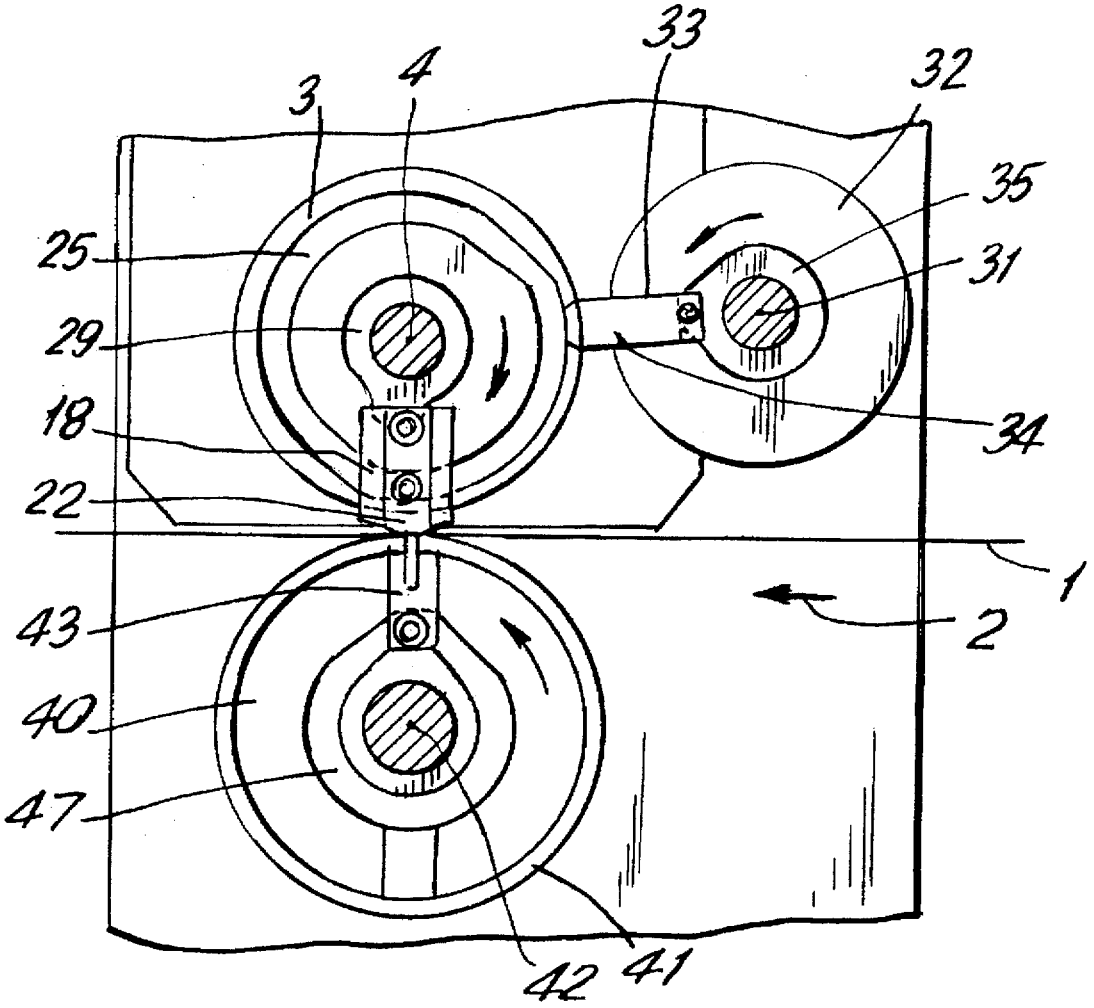
FIG. 1 is a schematic elevational view of a stapling device according to the present invention.
Figure 2:
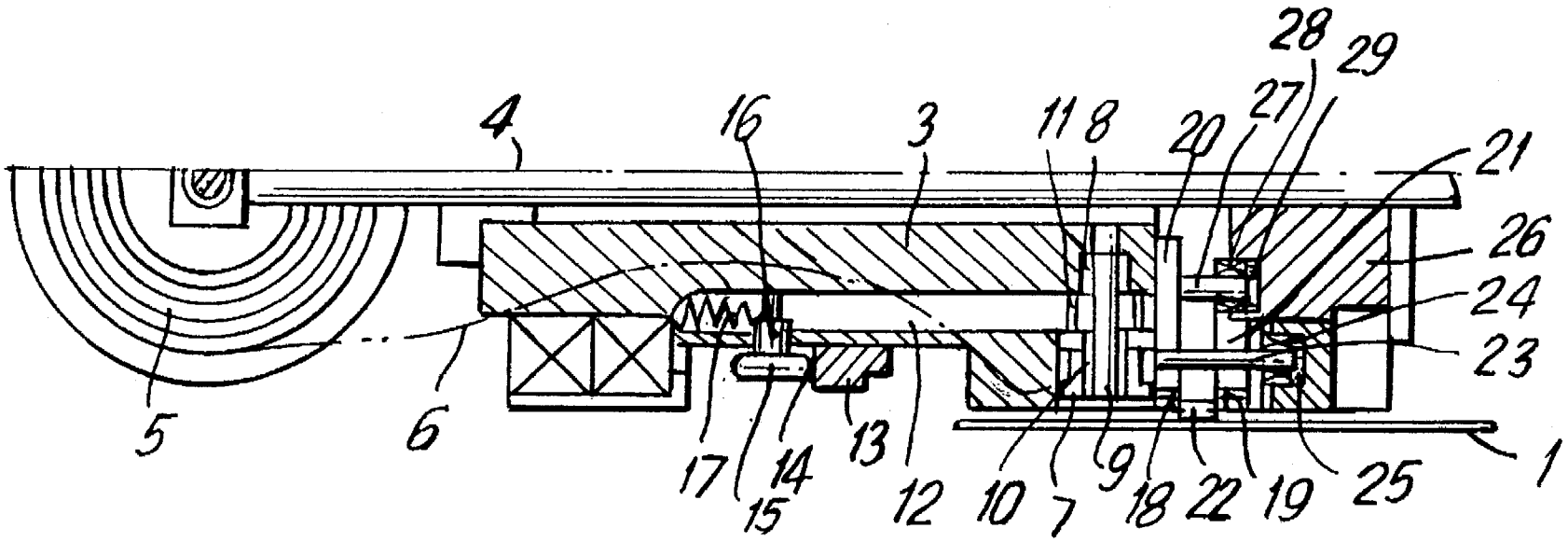
FIG. 2 is a partial sectional view of the drum-shaped body of the stapling device of FIG. 1.

FIG. 1 of the drawing is a schematic view of a stapling device for connecting products 1 formed of stacked and continuously transported webs or sheets of paper or the like by means of a wirelike stapling material which can be deformed into individual clamps. The products 1 are moved through the device in the direction of arrow 2 at a predetermined speed.

The stapling device according to the present invention is composed of a drum-shaped body 3 which, in the illustrated embodiment is located above the products 1 to be stapled and which is mounted so as to be rotatable about an axis 4. Connected to the drum-shaped body 4 is, for example, at least one supply roll 5 onto which the stapling material 6, for example, wire, is wound. The stapling material 6 is guided through openings and slots, not shown, to two conveying rollers 7 which are arranged next to each other perpendicularly of the plane of the drawing, wherein, consequently, only the front conveying roller 7 is visible. At least one of these conveying rollers may be driven in such a way that the stapling material 6 is pulled in a step-wise manner from the supply roll 5 by a predetermined, adjustable distance.

In the illustrated embodiment, the conveying roller 7 is mounted on a sleeve 8 which is rotatably supported on a peg 9. The sleeve 8 is connected to a conventional freewheel 10, only schematically illustrated, which is constructed in such a way that it takes along the sleeve 8 only in one direction of rotation. The freewheel 10 is additionally surrounded by a toothed ring 11 which meshes with a rack 12. Each time when the rack 12 moves in the direction toward the peg 9, the conveying roller 7 is rotated through the toothed ring 11, the freewheel 10 and the sleeve 8, and, consequently, the wire-like stapling material 6 is displaced by a corresponding distance.

For moving the rack 12, a stationary ring 13 equipped with a lifting cam 14 is arranged at a distance around the drum-shaped body 3. A running wheel 15, for example, formed by a ball bearing, rolls on this ring-shaped lifting cam 14. The bearing pin 16 of the running wheel 15 is rigidly connected to the rack 12. When the drum-shaped body 3 is rotated, the running wheel 15 rolls over the lifting cam 14 and displaces the rack 12 away from the peg 9. During this movement of the rack 12, the conveying roller 7 is not moved because of the presence of the freewheel 10. The rack 12 rests with its free end near the bearing pin 16 against a pretensioned compression spring 17 which moves the rack 12 in dependence on the lifting cam 14 back in the opposite direction and, thus, in the direction toward the peg 9. This means that, during a rotation of the drum-shaped body 3, the rack 12 carries out a conveying stroke for the stapling material 6 and an empty stroke. The axial displacement of the rack 12 can be changed and adapted to the respective requirements by exchanging the ring 13 with the lifting cam 14.

The wire-like stapling material 6 is moved by the conveying rollers 7 by a predetermined length out of the drum-shaped body 3 and is inserted into bores 18, 19 of a knife 20 and support 21. A plunger 22 is provided between the knife 20 and the support 21. As soon as conveying of the wire-like stapling material 6 has ended, the knife 20 is moved radially outwardly and, consequently, a straight piece for a clamp 37 is cut from the stapling material 6, wherein, however, the straight piece of stapling material 6 remains in the bores 18, 19 of the knife 20 and the support 21. For radially moving the knife 20, the latter is connected to a pin 23 whose free end supports a ball bearing 24. The ball bearing 24 is received in a guide groove 25 which is provided in a stationary part 26 arranged in front of the drum-shaped body 3. The circumferentially extending guide groove 25 is shaped in such a way that it has along its circumference a varying radial distance from the axis 4, so that the knife 20 carries out a cutting movement and a return movement.

The plunger 22 is also connected to a pin 27 whose free end is also equipped with a ball bearing 28. The ball bearing 28 is received in a circumferentially extending guide groove 29 of the stationary part 26, wherein the guide groove 29 also has over its circumference a varying axial distance from the axis 4. As a result, the plunger 22 also carries out a work stroke and a return stroke during a rotation of the drum-shaped body 3, as shall be further discussed below.

An axis 31 extending parallel to the axis 4 is provided laterally offset next to the drum-shaped body 3. On this axis 31 is mounted a rotatable body 32 in which a groove 33 is provided, as schematically illustrated in FIG. 1. A plunger-like clamp forming unit 34 is radially displaceably guided in the groove 33. The clamp forming unit 34 is radially displaced by means of an eccentric 35 which may also be a guide groove. By means of this eccentric 35, the clamp forming unit 35 can be introduced into a pocket, not illustrated in detail, which is formed on the drum-shaped body 3 in the guide area for the plunger 22 and is defined by the knife 20 and the support 21. The clamp forming unit 34 begins entering the pocket each time when the drum-shaped body 3 has carried out a rotation by an angle of approximately 225° from the position illustrated in FIG. 1. The clamp forming unit 34 leaves the pocket after a rotation of the drum-shaped body 3 by an angle of approximately 270°–280°. When the clamp forming unit 34 penetrates into the pocket, the previously cut piece of the stapling material 6 is deformed into a U-shaped clamp 37. This requires that the drum-shaped body 3 and the rotatable body 32 are driven synchronously, which advantageously can be effected through racks.

As soon as the clamp forming unit 34 has left the pocket at the drum-shaped body 3, the outward radial movement of the plunger 22 begins. During this movement, the previously formed clamp 37 also reaches the area of the conveyed product 1, wherein, during a further movement of the drum-shaped body 3 and a further movement of the plunger 22, the legs of the previously formed U-shaped clamp 37 are pushed in and then pushed through the product 1.

Figure 3:
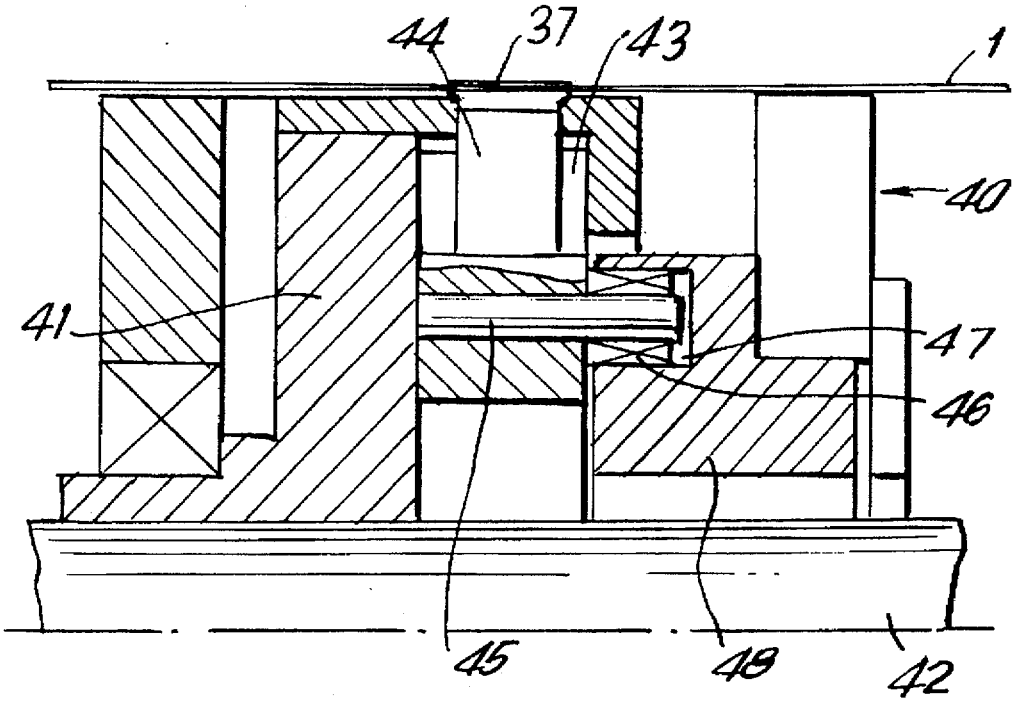
FIG. 3 is a partial sectional view of the clamp closing unit of the stapling device of FIG. 1.
Figure 4:
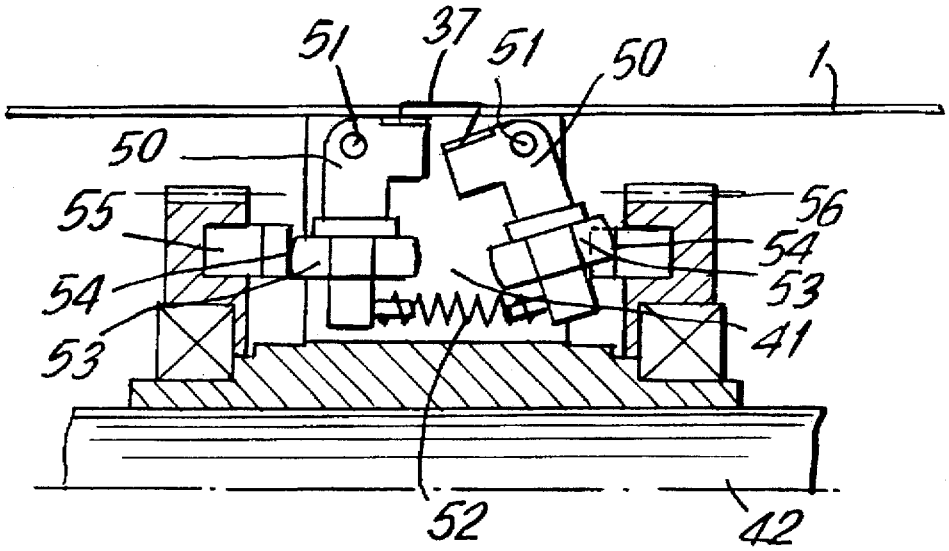
FIG. 4 is a partial sectional view showing another embodiment of a clamp closing unit.

A so-called clamp closing unit 40 is arranged underneath the product 1, wherein the clamp closing unit 40 may be configured as illustrated in FIGS. 3 or 4. This clamp closing unit 40 is mounted on a rotatable body 41 which is supported on an axis 42. The axis 42 extends parallel to the axis 4. Through conventional gear wheels, not illustrated in the drawing, the rotatable body 41 is in engagement with the drum-shaped body 3 and usually carries out a movement which is synchronous to the movement of the drum-shaped body 3. As illustrated in FIG. 3, a plunger 43 equipped with a tongue 44 is radially displaceably arranged in the rotatable body 41. On its free end face, the tongue 44 is provided with conventional closing recesses, not shown. The plunger 43 supports a pin 45 which is equipped with a ball bearing 46 at its end protruding out of the plunger 43. This ball bearing 46 is received in a guide groove 47 which is formed in a stationary, i.e., non-rotatable, part 48. This guide groove 47 has a varying radial distance from the axis 42. As a result, during a rotation of the rotatable body 41, the plunger 43 and, thus, the tongue 44 are moved radially outwardly and back.

The guide groove 47 is shaped in such a way that, when the rotatable body 41 with the plunger 43 approaches its position illustrated in FIG. 1, the plunger 43 and, thus, the tongue 44 are moved radially in the direction toward the drum-shaped body 3. At this point in time, the legs of the clamp 37 have already been punched through the product 1. The tongue 44 now grasps the ends of the legs of the clamp 37 and bends them inwardly. The stapled connection is now finished.

In the embodiment illustrated in FIG. 4, two tilting levers 50 are arranged in the rotatable body 41. Each tilting lever can be swung about an axis 51. As shown in the drawing, the tilting lever 50 on the right is in its initial position and the tilting lever 50 on the left is in its pivoted position. The two tilting levers 50 are held in their initial positions by means of a pretensioned compression spring 52.

Each tilting lever 50 supports at its longer lever arm a ball bearing 53 which serves as a running roller. Through the pretensioned compression spring 52, each ball bearing 53 rests against a control cam 54 which is formed by an end face of a ring 55. This ring 55 is inserted in a gear rim 56 which is only schematically illustrated and which is held in the rotatable body 41 so as to rotate therewith. When the rotatable body 41 rotates, the ball bearings 53 travel on the also stationary control cam 54. Consequently, the tilting levers 50 are moved always simultaneously by the control cam 54 from their respective initial position into the pivoted position which may also be called the closing position. During this pivoting movement of the tilting levers 50, the legs of the schematically illustrated clamp 37 extending through the product 1 are bent toward each other and, thus, the clamp 37 is closed. However, it is a requirement for this closing movement that the rotatable body 41 according to FIG. 4 also rotates synchronously with the drum-shaped body 3.

The embodiments described above may be modified so as to carry out the radial movements of the knife 20, the plunger 22, the clamp forming unit 34 and the plunger 43 as well as the pivoting movements of the tilting levers 50 in a different manner. However, it must always be insured that these movements are carried out at the correct point in time and take place synchronously.

While specific embodiments of the invention have been shown and described in detail to illustrate the inventive principles, it will be understood that the invention may be embodied otherwise without departing from such principles.

I claim:

1. A stapling device for connecting products formed from stacked and continuously conveyed webs or sheets of paper by means of a wire-like stapling material which is deformed into individual clamps, the stapling device having attached thereto a drum-shaped body mounted on one side of a travel path of the products and approximately contacting the travel path transversely of a conveying direction, the drum-shaped body comprising a supply roll and a conveying unit for the stapling material, a cutting device for severing the stapling material to a length required for forming a clamp, and a plunger for inserting the clamp into the products, further comprising a clamp forming unit comprising a pocket formed in the drum-shaped body and a clamp forming body radially displaceable in the pocket, the clamp forming body being synchronously rotatable with the drum-shaped body about an axis extending parallel to an axis of the drum-shaped body and being located on the same side of the travel path, and a rotatable body comprising a clamp closing unit located on a side of the travel path of the products opposite of the drum-shaped body and driven synchronously with the drum-shaped body.

2. The stapling device according to claim 1, wherein the conveying unit comprises two conveying rollers, further comprising means for driving the conveying rollers in a step-wise manner in a direction of rotation, the means for driving the conveying rollers comprising a rack extending in axial direction of the drum-shaped body and a freewheel, further comprising means for adjusting a stroke of the rack.

3. The stapling device according to claim 2, wherein the means for adjusting the stroke of the rack comprises a lifting cam mounted on a replaceable ring.

4. The stapling device according to claim 3, further comprising a restoring spring for carrying out a return stroke of the rack.

5. The stapling device according to claim 1, wherein the cutting device comprises knives radially guided on the drum-shaped body, further comprising a stationary control cam for moving the knives.

6. The stapling device according to claim 1, wherein the plunger is radially displaceably guided on the drum-shaped body, further comprising a stationary control cam for driving the plunger.

7. The stapling device according to claim 1, further comprising an eccentric for radially moving the clamp forming body on a disc rotatably mounted on the axis of the clamp forming body.

8. The stapling device according to claim 1, comprising a disc rotatably mounted about the axis of the clamp forming body, the disc comprising a control cam for radially displacing the clamp forming body.

9. The stapling device according to claim 1, wherein the clamp closing unit comprises a rotating and radially displaceable plunger, the plunger comprising a tongue mounted so as to be movable into the pocket of the drum-shaped body.

10. The stapling device according to claim 1, wherein the clamp closing unit comprises two tiltable levers swingably mounted on the rotatable body.

11. The stapling device according to claim 10, wherein the rotatable body comprises a stationary control cam for carrying out a pivoting movement of each tilting lever.

* * * * *